US008405648B2

(12) United States Patent
Cheng et al.

(10) Patent No.: US 8,405,648 B2
(45) Date of Patent: Mar. 26, 2013

(54) DRIVER CIRCUIT FOR BISTABLE DISPLAY DEVICE AND CONTROL METHOD THEREOF

(75) Inventors: Ying-Chuan Cheng, Hsinchu (TW); Rui-Yang Lai, Hsinchu (TW)

(73) Assignee: E Ink Holdings Inc., Hsinchu County (TW)

( * ) Notice: Subject to any disclaimer, the term of this patent is extended or adjusted under 35 U.S.C. 154(b) by 445 days.

(21) Appl. No.: 12/775,559

(22) Filed: May 7, 2010

(65) Prior Publication Data

US 2011/0057916 A1 Mar. 10, 2011

(30) Foreign Application Priority Data

Sep. 8, 2009 (TW) ..... 98130299 A

(51) Int. Cl.
*G09G 5/00* (2006.01)

(52) U.S. Cl. ..... 345/211; 345/107

(58) Field of Classification Search ..... 345/107, 345/211

See application file for complete search history.

(56) References Cited

U.S. PATENT DOCUMENTS 6,084,384 A * 7/2000 Kawamoto et al. ..... 323/269
7,034,783 B2 * 4/2006 Gates et al. ..... 345/84
2002/0195980 A1 * 12/2002 Furui ..... 318/254

FOREIGN PATENT DOCUMENTS

CN 1823360 A 8/2006
CN 100483499 C 4/2009
CN 101443837 A 5/2009

OTHER PUBLICATIONS

China Official Action issued on Dec. 28, 2012.

* cited by examiner

*Primary Examiner* — Kevin M Nguyen
*Assistant Examiner* — Sepideh Ghafari
(74) *Attorney, Agent, or Firm* — Chun-Ming Shih

(57) ABSTRACT

An exemplary driver circuit for bistable display device includes a plurality of pixel electrodes, a first power supply, a second power supply, a high-voltage gate control port selectively driven by the first power supply, a low-voltage gate control port selectively driven by the second power supply, a reference potential port, a first discharging circuit connecting the high-voltage gate control port to the ground, a second discharging circuit connecting the low-voltage gate control port to the ground, and a switch for deciding whether the reference potential port is electrically connected to a reference voltage source or not.

14 Claims, 2 Drawing Sheets

DRIVER CIRCUIT FOR BISTABLE DISPLAY DEVICE AND CONTROL METHOD THEREOF

CROSS-REFERENCE TO RELATED APPLICATIONS

This application is based upon and claims the benefit of priority from the prior Taiwan Patent Application No. 098130299, filed Sep. 8, 2009, the entire contents of which are incorporated herein by reference.

BACKGROUND

1. Technical Field

The present invention generally relates to driver circuits for bistable display devices and control methods thereof and, particularly to a driver circuit for a bistable display device and a control method thereof which can improve the stability of picture optical parameters and image display quality of the bistable display device.

2. Description of the Related Art

Nowadays, applications of slim display devices are becoming more common and bring people's lives with great convenience. An electronic paper display device is a kind of flat panel display device and is regarded as one next-generation display technology due to its advantages of portable and low power consumption.

The electronic paper display device generally has two substrates. A plurality of black particles with positive charges, white particles with negative charges and a solvent are injected between the substrates. One of the substrates is a transparent/translucent substrate, a region of the transparent substrate which is applied with a positive voltage would attract the white particles with negative charges and whereby displays a white state, and another region of the transparent substrate which is applied with a negative voltage would attract the black particles with positive charges and whereby displays a black state. The other substrate has a plurality of common electrodes with a voltage reference formed thereon. The electronic paper (i.e., generally e-paper) display device has bistable characteristic, since the solvent and the charged particles have approximate the same specific gravity, even if the applied electric filed is withdrawn, the charged particles still can be maintained at a fixed position for a considerable period of time until the next electric field is applied. The applied next electric filed would cause the charged particles to move again for displaying another image. Therefore, continuous charging is not needed after updating an image every time and thus low power consumption is achieved.

A driver circuit for the electronic paper display device generally includes a plurality of pixel electrodes, a plurality of high-voltage gate control ports each for providing a first control voltage to control whether to supply one of the pixel electrodes with a high voltage, a plurality of low-voltage gate control port each for providing a second control voltage to control whether to supply one of the pixel electrodes with a low voltage, and a reference potential port for providing a reference potential as a voltage reference for powering the pixel electrodes. When a power supply is stopped, the high-voltage gate control port and the low-voltage gate control port naturally discharge through respective voltage stabilizing capacitor, and thus the discharging speeds are relatively slow; the reference potential port discharges the voltage stabilizing capacitor to the ground through a discharging path controlled by a switch, and thus the discharging speed is relatively fast. However, the above-mentioned situations associated with the relatively slow discharging speeds of the high-voltage gate control port and the low-voltage gate control port and the relatively fast discharging speed of the reference potential port would easily result in the change of picture optical parameters of the bistable display device and therefore the image display quality of the bistable display device is degraded.

BRIEF SUMMARY

Accordingly, what is needed is to provide a driver circuit for bistable display device and a control method thereof which can improve the stability of picture optical parameters and the image display quality.

In order to achieve the above-mentioned objective, or to achieve other objectives, a driver circuit for a bistable display device in accordance with an embodiment of the present invention is provided. The driver circuit for the bistable display device includes a plurality of pixel electrodes, a first power supply, a second power supply, a high-voltage gate control port, a low-voltage gate control port, a reference voltage source, a first discharging circuit, a second discharging circuit and a switch. The high-voltage gate control port is selectively driven by the first power supply and configured (i.e., structured and arranged) for providing a first control voltage to control whether to supply the pixel electrodes with a high voltage. The low-voltage gate control port is selectively driven by the second power supply and configured for providing a second control voltage to control whether to supply the pixel electrodes with a low voltage. The reference voltage source is configured for supplying a reference potential to a reference potential port as a voltage reference for powering the pixel electrodes. The first discharging circuit electrically connects the high-voltage gate control port to the ground and is configured for accelerating an electrical discharge of the high-voltage gate control port when the first power supply stops driving the high-voltage gate control port. The second discharging circuit electrically connects the low-voltage gate control port to the ground and is configured for accelerating an electrical discharge of the low-voltage gate control port when the second power supply stops driving the low-voltage gate control port. The switch is switched to allow the reference potential port to electrically communicate with the reference voltage source when the first power supply and the second power supply respectively drive the high-voltage gate control port and the low-voltage gate control port. The switch further is switched to cut off the electrical communication between the reference potential port and the reference voltage source when the first power supply and the second power supply respectively stop driving the high-voltage gate control port and the low-voltage gate control port.

A control method of the above-mentioned driver circuit for the bistable display device in accordance with an embodiment of the present invention includes: accelerating an electrical discharge of the high-voltage gate control port by the first discharging circuit electrically connecting the high-voltage gate control port to the ground when the first power supply stops driving the high-voltage gate control port; accelerating an electrical discharge of the low-voltage gate control port by the second discharging circuit electrically connecting the low-voltage gate control port to the ground when the second power supply stops driving the low-voltage gate control port; and cutting off the electrical communication between the reference potential port and the reference voltage source by the switch when the first power supply and the second power supply respectively stop driving the high-voltage gate control port and the low-voltage gate control port.

In the above-mentioned embodiments of the present invention, when the first power supply and the second power supply respectively stop driving the high-voltage gate control port and the low-voltage gate control port, since the first discharging circuit acts as an additional discharging circuit can accelerate the electrical discharge of the high-voltage gate control port, the second discharging circuit acts as another additional discharging circuit can accelerate the electrical discharge of the low-voltage gate control port, and the switch seemingly separates the panel from the system so that the reference potential port is absent to form a closed-loop, therefore the influence applied to image quality is extremely small during the discharging process of the high-voltage gate control port and the low-voltage gate control port. As a result, the stability of picture optical parameters and the image display quality both are improved.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

In the following detailed description of the preferred embodiments, reference is made to the accompanying drawings which form a part hereof, and in which is shown by way of illustration specific embodiments in which the invention may be practiced.

Figure 1:
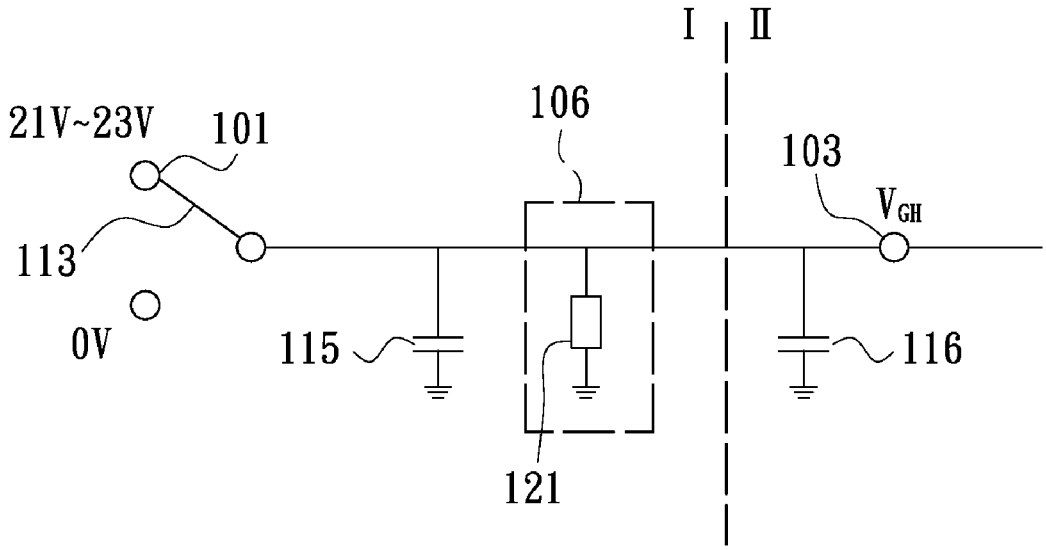
FIG. 1 is a schematic diagram of a first control voltage part of a driver circuit for a bistable display device in accordance with an embodiment of the present invention.
Figure 2:
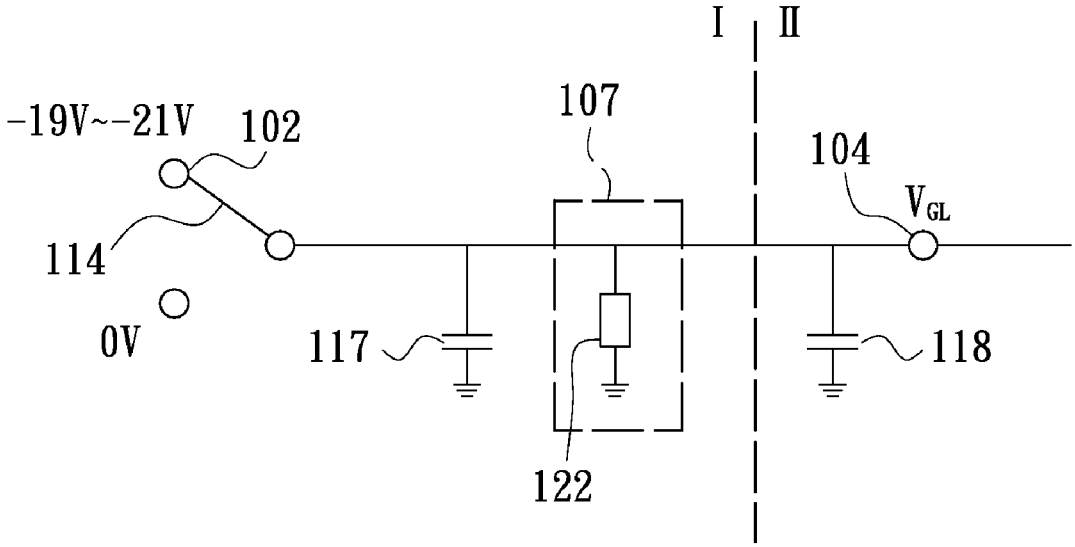
FIG. 2 is a schematic diagram of a second control voltage part of the driver circuit for the bistable display device in FIG. 1.
Figure 3:
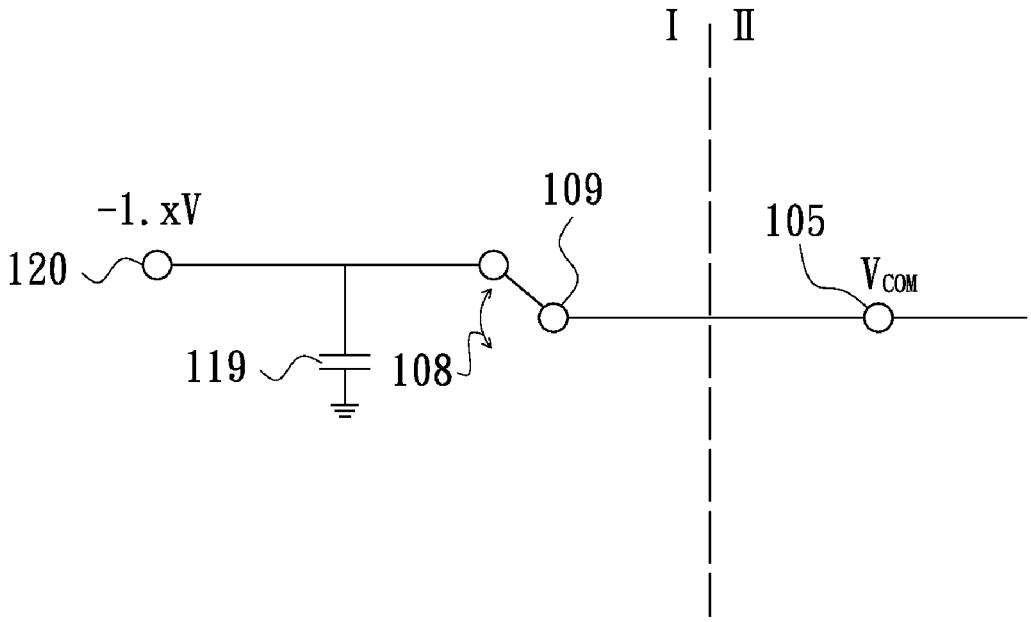
FIG. 3 is a schematic diagram of a reference potential part of the driver circuit for the bistable display device in FIG. 1.

Referring to FIGS. 1, 2 and 3, a driver circuit for a bistable display device in accordance with an embodiment of the present invention includes a first power supply 101, a second power supply 102, a high-voltage gate control port 103, a low-voltage gate control port 104, a reference potential port 105, a first discharging circuit 106 electrically connecting the high-voltage gate control port 103 to the ground, a second discharging circuit 107 electrically connecting the low-voltage gate control port 104 to the ground, a plurality of switches 109, 113 and 114, a reference voltage source 120, a high voltage source (not shown), a low voltage source (not shown) and a plurality of pixel electrodes (not shown). In the illustrated embodiment, the bistable display device is an electrophoretic display device.

As illustrated in FIG. 1, the high-voltage gate control port 103 is selectively driven by the first power supply 101 and configured (i.e., structured and arranged) for providing a first control voltage $V_{GH}$ to control the high-voltage source whether to supply corresponding one of the pixel electrodes with a high voltage. In the illustrated embodiment, a voltage supplied by the first power supply 101 is 21 volts~23 volts (V). When updating a display image of the bistable display device, the switch 113 connects the first power supply 101 to the high-voltage gate control port 103 (i.e., the electrical communication between the first power supply 101 and the high-voltage gate control port 103 is established); at this time, the high-voltage gate control port 103 is driven by the first power supply 101 and provides the fist control voltage $V_{GH}$ to enable the high-voltage source to supply the corresponding one of the pixel electrodes with the high voltage. After the display image of the bistable display device is updated, the switch 113 is switched to cut off the electrical communication between the first power supply 101 and the high-voltage gate control port 103; at this moment, the first power supply 101 stops driving the high-voltage gate control port 103 so that the high voltage source stops supplying the corresponding one of the pixel electrodes with the high voltage. It is indicated that, although FIG. 1 shows the switch 113 is switchable between the first power supply 101 and 0 volt, the 0 volt actually represents an input voltage is cut off and thus not necessarily must be 0 volt. In other words, the switch 113 actually is electrically connected with the first power supply 101, the two kinds of voltages (i.e., 21V~23V and 0V) between which the switch 113 is switchable respectively represent two states of power-supplying and power non-supplying of the first power supply 101.

As illustrated in FIG. 2, the low-voltage gate control port 104 is selectively driven by the second power supply 102 and configured for providing a second control voltage $V_{GL}$ to control the low-voltage source whether to supply corresponding one of the pixel electrodes with a low voltage. Herein, the low voltage is lower than the above-mentioned high voltage. In the illustrated embodiment, a voltage supplied by the second power supply 1021 is −19V~−21V. When updating a display image of the bistable display device, the switch 114 connects the second power supply 102 to the low-voltage gate control port 104 (i.e., the electrical communication between the second power supply 102 and the low-voltage gate control port 104 is established); at this time, the low-voltage gate control port 104 is driven by the second power supply 102 and provides the second control voltage $V_{GL}$ to enable the low voltage source to supply the corresponding one of the pixel electrodes with the low voltage. After the display image of the bistable display device is updated, the switch 114 is switched to cut off the electrical communication between the second power supply 102 and the low-voltage gate control port 104; at this moment, the second power supply 102 stops driving the low-voltage gate control port 104 so that the low voltage source stops supplying the corresponding one of the pixel electrodes with the low voltage. Likewise, although FIG. 2 shows the switch 114 is switchable between the second power supply 102 and 0 volt, the 0 volt actually represents an input voltage is cut off and thus not necessarily must be 0 volt. In other words, the switch 114 actually is electrically connected with the second power supply 102, the two kinds of voltages (i.e., −19V~−21V and 0V) between which the switch 114 is switchable respectively represent two states of power-supplying and power non-supplying of the second power supply 102.

As illustrated in FIG. 3, the reference potential port 105 is configured for providing a reference potential $V_{COM}$ as a voltage reference for powering the pixel electrodes. In the illustrated embodiment, when updating a display image of the bistable display device, the switch 109 connects the reference potential port 105 to the reference voltage source 120 for providing a voltage falling in between −1V and −2V; at this time, the reference voltage source 120 supplies the reference potential $V_{COM}$. After the display image of the bistable display device is updated, the switch 109 is switched off so that the reference potential port 105 is not electrically communicated with the reference voltage source 120. It is noted that there are many approaches to achieve the purpose of using the switch 109 to cut off the electrical communication between the reference potential port 105 and the reference voltage source 120, for example, if the switch 109 is a mechanical switch (e.g., the switch as shown in FIG. 3), the switch 109 can be directly jumped on/off (e.g., moving according to the manner denoted by the switching direction 108) so as to determine to close/open the electrical conduction path between the reference potential port 105 and the reference voltage source 120; if the switch 109 is an electronic switch (e.g., FET), a conduction path of the switch 109 can be shut off (e.g., by controlling the gate potential of the FET to shut off the conduction path between the source and drain), at this moment, the switch 109 would form a high impedance circuit between the reference potential port 105 and the reference voltage source 120, such a situation also can be considered as an open-circuit state.

Still referring to FIGS. 1, 2 and 3, the driver circuit for the bistable display device in the illustrated embodiment further includes two voltage stabilizing capacitors 115, 116 electrically connected between the high-voltage gate control port 103 and the ground, two voltage stabilizing capacitors 117, 118 electrically connected between the low-voltage gate control port 104 and the ground, and one voltage stabilizing capacitor 119 electrically connected between the reference voltage source 120 and the ground. It is understood that, after a display image of the bistable display device is updated, each of the voltage stabilizing capacitors 115, 116, 117, 118, 119 has an amount of charges stored therein. However, the voltage stabilizing capacitor 119 would not be discharged, this is because the voltage stabilizing capacitor 119 is electrically connected to the left side of the switch 109.

Generally, the bistable display device includes a controller module and a panel module as two parts thereof. The two parts are separately manufactured in the production process and then are assembled together. In the illustrated embodiment, the dashed lines in FIG. 1, FIG. 2 and FIG. 3 respectively divide the circuits illustrated in FIG. 1, FIG. 2 and FIG. 3 into part I and part II. The circuit in the part I belongs to the controller module of the bistable display device (generally arranged on a system printed circuit board), the circuit in the part II belongs to the panel module of the bistable display device.

The first discharging circuit 106 is configured for accelerating an electrical discharge of the high-voltage gate control port 103 to the ground, when the first power supply 101 stops driving the high-voltage gate control port 103. In the illustrated embodiment, the first discharging circuit 106 includes a resistor 121. The resistor 121 is electrically connected between the high-voltage gate control port 103 and the ground. In contrast, the prior art has no the first discharging circuit 106 and thereby there is no appropriate discharging path for the electrical discharge of the high-voltage gate control port 103. Generally speaking, the high-voltage gate control port 103 in the prior art only can naturally discharge through the floating first power supply 101 (i.e., the 0V joint to which the switch 113 in FIG. 1 is switched) and the voltage stabilizing capacitors 115, 116. In light of this point of view, the additional first discharging circuit 106 provided in the illustrated embodiment can provide an additional discharging path to accelerate the electrical discharge of the high-voltage gate control port 103 to the ground.

The second discharging circuit 107 is configured for accelerating an electrical discharge of the low-voltage gate control port 104 to the ground, when the second power supply 102 stops driving the low-voltage gate control port 104. In the illustrated embodiment, the second discharging circuit 107 includes a resistor 122. The resistor 122 is electrically connected between the low-voltage gate control port 104 and the ground. Similarly, since an additional discharging circuit is provided, the solution associated with the illustrated embodiment can accelerate the electrical discharge of the low-voltage gate control port 104 to the ground.

In term of the additional discharging circuits respectively being provided to the high-voltage gate control port and the low-voltage gate control port in FIGS. 1 and 2, FIG. 3 is directed to how to minimize the adverse effects applied to the image quality during the electrical discharges of $V_{GH}$, $V_{GL}$. In the illustrated embodiment, when the first power supply 101 and the second power supply 102 respectively stop driving the high-voltage gate control port 103 and the low-voltage gate control port 104, the switch 109 is switched to cut off the electrical communication between the reference potential port 105 and the reference voltage source 120. In the prior art, once the driving power applied to the panel is stopped, the reference potential port 105 will discharge though a switch to the ground (since the reference potential port 105 and the switch 109 have a large capacitor electrically connected therebetween and arranged on the system printed circuit board). Contradistinctively, in order to minimize the adverse effects applied to the image quality during the electrical discharges of $V_{GH}$, $V_{GL}$, the switch 109 is switched to cut off the electrical communication between the reference potential port 105 and the system terminal when there is no power supplied to the panel (since the large capacitor is modified to electrically connect between the switch 109 and the reference voltage source 120 and therefore not necessarily to discharge). It is noted that, the switch 109 can be an electronic switch e.g., an analog multiplexer, an analog switch or a metal-oxide-semiconductor field effect transistor (MOSFET), and so on. Alternatively, the switch 109 can be a mechanical switch e.g., a normally open electric relay.

A control method of the driver circuit 100 for the bistable display device in accordance with an embodiment of the present invention will be described below in detail. The control method includes the following steps of:

when the first power supply 101 stops driving the high-voltage gate control port 103, accelerating an electrical discharge of the high-voltage gate control port 103 to the ground by the first discharging circuit 106 electrically connecting the high-voltage gate control port 103 to the ground;

when the second power supply 102 stops driving the low-voltage gate control port 104, accelerating an electrical discharge of the low-voltage gate control port 104 to the ground by the second discharge circuit 107 electrically connecting the low-voltage gate control port 104 to the ground; and when the first power supply 101 and the second power supply 102 respectively stop driving the high-voltage gate control port 103 and the low-voltage gate control port 104, cutting off the electrical communication between the reference potential port and the system terminal.

Compared with the prior art, the above-mentioned embodiments of the present invention use the first discharging circuit 106 electrically connecting the high-voltage gate control port 103 to the ground, the second discharging circuit 107 electrically connecting the low-voltage gate control port 104 to the ground, and the switch 109 for switching the electrical conduction states between the reference potential port 105 and the reference voltage source 120. When the first power supply 101 and the second power supply 102 respectively stop driving the high-voltage gate control port 103 and the low-voltage gate control port 104, the first discharging circuit 106 acts as an additional discharging path can accelerate the discharging speed of the high-voltage gate control port 103, the second discharging circuit 107 acts as an additional discharging path can accelerate the discharging speed of the low-voltage gate control port 104, and the switch 109 is switched to cut off the electrical communication between the reference potential port 105 and the reference voltage source 120 so as to slow down the discharging speed of the reference potential port 105. As a result, the stability of picture optical parameters and the image display quality associated with the bistable display device both are improved.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driver circuit for a bistable display device comprising:
a plurality of pixel electrodes;
a first power supply;
a second power supply;
a reference voltage source configured for supplying a reference potential;
a high-voltage gate control port selectively driven by the first power supply and configured for providing a first control voltage to control whether to supply the pixel electrodes with a high voltage;
a low-voltage gate control port selectively driven by the second power supply and configured for providing a second control voltage to control whether to supply the pixel electrodes with a low voltage;
a reference potential port configured for receiving and providing the reference potential as a voltage reference for powering the pixel electrodes;
a first discharging circuit electrically connecting the high-voltage gate control port to the ground and configured for accelerating an electrical discharge of the high-voltage gate control port when the first power supply stops driving the high-voltage gate control port;
a second discharging circuit electrically connecting the low-voltage gate control port to the ground and configured for accelerating an electrical discharge of the low-voltage gate control port when the second power supply stops driving the low-voltage gate control port; and
a switch;
wherein when the first power supply and the second power supply respectively drive the high-voltage gate control port and the low-voltage gate control port, the switch is switched to allow the reference potential port to electrically communicate with the reference voltage source;
wherein when the first power supply and the second power supply respectively stop driving the high-voltage gate control port and the low-voltage gate control port, the switch is switched to cut off the electrical communication between the reference potential port and the reference voltage source.

2. The driver circuit as claimed in claim 1, wherein the switch comprises a mechanical switch.

3. The driver circuit as claimed in claim 1, further comprising at least a voltage stabilizing capacitor electrically connected between the high-voltage gate control port and the ground.

4. The driver circuit as claimed in claim 1, further comprising at least a voltage stabilizing capacitor electrically connected between the low-voltage gate control port and the ground.

5. The driver circuit as claimed in claim 1, further comprising at least a voltage stabilizing capacitor electrically connected between the reference potential port and the ground.

6. The driver circuit as claimed in claim 1, wherein the first discharging circuit comprises a resistor electrically connected between the high-voltage gate control port and the ground.

7. The driver circuit as claimed in claim 1, wherein the second discharging circuit comprises a resistor electrically connected between the low-voltage gate control port and the ground.

8. The driver circuit as claimed in claim 1, wherein the bistable display device is an electrophoretic display device.

9. A control method of a driver circuit for a bistable display device, the driver circuit comprising a plurality of pixel electrodes, a first power supply, a second power supply, a high-voltage gate control port selectively driven by the first power supply and configured for providing a first control voltage to control whether to supply the pixel electrodes with a high voltage, a low-voltage gate control port selectively driven by the second power supply and configured for providing a second control voltage to control whether to supply the pixel electrodes with a low voltage, a reference potential port configured for providing a reference potential as a voltage reference for powering the pixel electrodes, and a switch; the control method comprising:
when the first power supply stops driving the high-voltage gate control port, accelerating an electrical discharge of the high-voltage gate control port by a first discharging circuit electrically connecting the high-voltage gate control port to the ground;
when the second power supply stops driving the low-voltage gate control port, accelerating an electrical discharge of the low-voltage gate control port by a second discharging circuit electrically connecting the low-voltage gate control port to the ground; and
when the first power supply and the second power supply respectively stop driving the high-voltage gate control port and the low-voltage gate control port, cutting off the switch.

10. The control method as claimed in claim 9, wherein at least a voltage stabilizing capacitor is electrically connected between the high-voltage gate control port and the ground.

11. The control method as claimed in claim 9, wherein at least a voltage stabilizing capacitor is electrically connected between the low-voltage gate control port and the ground.

12. The control method as claimed in claim 9, wherein the bistable display device is an electrophoretic display device.

13. A driver circuit for a bistable display device comprising:
a plurality of pixel electrodes;
a first power supply;
a first-voltage gate control port selectively driven by the first power supply and configured for providing a first control voltage to control whether to supply the pixel electrodes with a first voltage; and
a first discharging circuit electrically connecting the first-voltage gate control port to the ground and configured for accelerating an electrical discharge of the first-voltage gate control port when the first power supply stops driving the first-voltage gate control port.

14. A driver circuit for a bistable display device comprising:
a first power supply;
a second power supply;
a reference voltage source configured for supplying a reference potential;
a high-voltage gate control port selectively driven by the first power supply and configured for providing a first control voltage to control whether to supply the pixel electrodes with a high voltage;
a low-voltage gate control port selectively driven by the second power supply and configured for providing a second control voltage to control whether to supply the pixel electrodes with a low voltage;

a reference potential port configured for receiving and providing the reference potential as a voltage reference for powering the pixel electrodes; and a switch;

wherein when the first power supply and the second power supply respectively drive the high-voltage gate control port and the low-voltage gate control port, the switch is switched to allow the reference potential port to electrically communicate with the reference voltage source, when the first power supply and the second power supply respectively stop driving the high-voltage gate control port and the low-voltage gate control port, the switch is switched to cut off the electrical communication between the reference potential port and the reference voltage source.

* * * * *